US009695818B2

(12) United States Patent
Tsuda et al.

(10) Patent No.: US 9,695,818 B2
(45) Date of Patent: Jul. 4, 2017

(54) GAS COMPRESSOR

(71) Applicant: CALSONIC KANSEI CORPORATION, Saitama (JP)

(72) Inventors: Masahiro Tsuda, Saitama (JP); Hirotada Shimaguchi, Saitama (JP); Tatsuya Osaki, Saitama (JP); Kouji Hirono, Saitama (JP); Shizuma Kaneko, Saitama (JP)

(73) Assignee: CALSONIC KANSEI CORPORATION, Saitama (JP)

( * ) Notice: Subject to any disclaimer, the term of this patent is extended or adjusted under 35 U.S.C. 154(b) by 28 days.

(21) Appl. No.: 14/401,217

(22) PCT Filed: May 20, 2013

(86) PCT No.: PCT/JP2013/063975
§ 371 (c)(1),
(2) Date: Nov. 14, 2014

(87) PCT Pub. No.: WO2013/183436
PCT Pub. Date: Dec. 12, 2013

(65) Prior Publication Data

US 2015/0132168 A1 May 14, 2015

(30) Foreign Application Priority Data

Jun. 4, 2012 (JP) ..... 2012-126658
Jun. 4, 2012 (JP) ..... 2012-126659

(51) Int. Cl.
*F03C 2/00* (2006.01)
*F01C 21/08* (2006.01)
(Continued)

(52) U.S. Cl.
CPC ..... *F04C 15/06* (2013.01); *F04C 2/22* (2013.01); *F04C 18/3441* (2013.01);
(Continued)

(58) Field of Classification Search
CPC .... F04C 15/06; F04C 18/3441; F04C 29/026; F04C 29/12; F04C 28/16
(Continued)

(56) References Cited

U.S. PATENT DOCUMENTS 3,652,191 A * 3/1972 King ..... F04C 27/001 418/125
3,743,453 A * 7/1973 Abendschein ..... F04B 39/16 418/88
(Continued)

FOREIGN PATENT DOCUMENTS

JP 51-2015 1/1976
JP 54-28008 3/1979
(Continued)

OTHER PUBLICATIONS

International Search Report (ISR) issued Aug. 20, 2013 in International (PCT) Application No. PCT/JP2013/063975.

*Primary Examiner* — Deming Wan
(74) *Attorney, Agent, or Firm* — Wenderoth, Lind & Ponack, L.L.P.

(57) ABSTRACT

A compressor (100) has a compressor main body (60) formed so that one stroke cycle is performed in a compression room (43) which is partitioned by a rotor (50), cylinder (40), side blocks (20, 30), and vanes (58) during one revolution of the rotor (50). A cyclone block (70) separates a refrigerant oil (R) from refrigerant gas (G), wherein a second discharge section (46) which discharge the refrigerant gas (G) when the pressure inside the compression room (43) reaches the discharge pressure before the compression room (43) faces a first discharge section (45) is formed, and a communicating path (39) which connects a discharge chamber (45*a*) in the first discharge section (45) and a discharge chamber (46*a*) in the second discharge section
(Continued)

(46) is formed on the upper stream side from the cyclone block (70).

3 Claims, 3 Drawing Sheets

(51) Int. Cl.

| | |
|---|---|
| ***F04C 15/06*** | (2006.01) |
| ***F04C 18/34*** | (2006.01) |
| ***F04B 49/035*** | (2006.01) |
| ***F04B 49/24*** | (2006.01) |
| ***F04C 29/12*** | (2006.01) |
| ***F04C 23/00*** | (2006.01) |
| ***F04C 29/02*** | (2006.01) |
| ***F04C 18/344*** | (2006.01) |
| ***F04C 2/22*** | (2006.01) |
| *F04C 28/16* | (2006.01) |

(52) U.S. Cl.
CPC ..... *F04C 23/008* (2013.01); *F04C 29/026* (2013.01); *F04C 29/12* (2013.01); *F04C 28/16* (2013.01)

(58) Field of Classification Search
USPC ..... 418/83, 259, 236, 238, 270, DIG. 1, 15, 418/180; 417/284
See application file for complete search history.

(56) References Cited

U.S. PATENT DOCUMENTS

| | | | | |
|---|---|---|---|---|
| 3,865,515 | A * | 2/1975 | Allen | F01C 21/10 417/283 |
| 5,094,592 | A | 3/1992 | Nakajima et al. | |
| 2006/0073033 | A1 | 4/2006 | Sundheim | |

FOREIGN PATENT DOCUMENTS

| | | |
|---|---|---|
| JP | 56-54986 | 5/1981 |
| JP | 56-150886 | 11/1981 |
| JP | 60-1389 | 1/1985 |
| JP | 1-28231 | 6/1989 |
| JP | 10-220376 | 8/1998 |

* cited by examiner

GAS COMPRESSOR

TECHNICAL FIELD

The present invention relates to a gas compressor. More particularly, the present invention relates to an improvement of a discharge path in a vane-rotary type gas compressor.

BACKGROUND ART

An air-conditioning system includes a gas compressor which compresses gas, such as refrigerant gas in order to circulate gas in the air-conditioning system.

The gas compressor includes a compressor main body which is housed in a housing and compresses gas by rotational drive. The housing includes inside thereof a discharge room where the high-pressure gas from the compressor main body is discharged. The discharge room is formed by being partitioned by the housing and the compressor main body. The high-pressure gas is discharged from the discharge room outside the housing.

As an example of such a gas compressor, a so-called vane rotary type gas compressor, is known.

Such a vane-rotary type gas compressor includes a compressor main body housed inside a housing. The compressor main body includes an approximately cylindrical rotor which rotates along a rotation shaft integrally, a cylinder which includes an inner-circumferential surface with a contour shape to surround a circumferential surface of the rotor from the outside, a plurality of plate-like vanes which are housed in a vane groove formed in the rotor to be projectable from the circumferential surface of the rotor toward the outside, and a side block which includes a bearing being formed so as to support the rotation shaft which projects from both end surfaces of the rotor to be rotatable, at the same time as contacts with both end surfaces of the rotor and the cylinder and shields their end surfaces. A cylinder room in which suction, compression, and discharge of the gas are performed is formed in the vane-rotary type gas compressor by the outer circumferential surface of the rotor, the inner circumferential surface of the cylinder, and each inner surface of the both side blocks.

By the configuration such that the leading end of each vane projecting from the circumferential surface of the rotor contacts the inner circumferential surface of the cylinder, the cylinder room is partitioned into a plurality of compression rooms by the outer circumferential surface of the rotor, the inner circumferential surface of the cylinder, each inner surface of the both side blocks, and the surfaces of two vanes provided back and forth along the rotational direction of the rotor.

Then, the high-pressure gas compressed in the compression room is discharged outside the compressor main body through the discharge section formed in the cylinder (refer to Patent Literature 1).

CITATION LIST

Patent Literature

Patent Literature 1: Japanese Patent Laid-Open Publication No. S54-28008

SUMMARY OF THE INVENTION

Technical Problem

Each compression room in the compressor main body of the gas compressor described in the above citation is configured to perform only one cycle of suction, compression, and discharge of the gas from the discharge section formed in the cylinder during one revolution of the rotor. Therefore, because the compression time becomes long, a case in which the pressure of the gas inside the compression room reaches the desired discharge pressure before the compression room faces the discharge section may occur.

In the above instance, the internal space of the compression room is in a state of excessive compression, and a power increase may be caused therein.

The present invention has been made taking the above into consideration, and an object of the present invention is to provide a gas compressor in which an excessive compression inside a compression room can be prevented at the same time as the configuration of an oil separator disposed in the compressor main body or disposed outside the compressor main body can be simplified.

Solution to Problem

A gas compressor according to present invention includes a compressor main body which is formed so as to perform only one cycle of suction, compression, and discharge of gas during one revolution of the rotor. By comprising a sub-discharge section (second discharge section) in addition to a main discharge section (first discharge section), which is provided before the first discharge section, the excessive compression in the compression room can be prevented. In addition, by connecting the first discharge section and the second discharge section through a communication path, the gas discharged from each discharge section can be discharged through a single discharge path to the outside of the compressor main body. That is, the gas from the both discharge sections is not discharged through each separated path toward the oil separator disposed outside the compressor main body. Thereby, the configuration of the compressor main body and the oil separator can be simplified.

That is, the gas compressor according to the present invention includes: an approximate cylindrical rotor being rotatable around a shaft; a cylinder having an inner circumferential surface which has a contour shape surrounding the rotor from outside of an outer circumferential surface of the rotor; a plurality of plate-like vanes disposed to be projectable from the rotor toward the outside by a back pressure from a vane groove which is formed in the rotor; two side blocks contacting and shielding both end surfaces of the rotor and the cylinder; a compressor main body including inside thereof a plurality of compression rooms which are partitioned by the rotor, the cylinder, the two side blocks, and the vanes, and each compression room being formed so as to perform only one cycle of suction, compression, and discharge of the gas through the first discharge section in the cylinder during one revolution of the rotor; and an oil separator separating oil from the gas discharged from the compressor main body, the oil being separated from the gas while the gas passes through the oil separator. The cylinder includes a second discharge section discharging the gas inside the compression room when the pressure of the gas inside the compression room reaches the discharge pressure before the compression room faces the first discharge section by the rotation of the rotor, and a communicating path connecting the first discharge section and the second discharge section is formed on an upper stream side of a flow of the gas to the oil separator.

Effect of the Invention

According to the gas compressor in Embodiments of the present invention, the compressor main body and/or the oil separator disposed outside the compressor main body can be simplified at the same time as the excessive compression inside the compression room can be prevented.

DESCRIPTION OF AN EMBODIMENT

Hereinafter, a detailed Embodiment of a gas compressor according to the present invention will be described with reference to the drawings.

A vane-rotary compressor 100 (hereinafter, simply referred to as compressor 100) of an example according to the present invention is used as a gas compressor in an air-conditioning system which is installed in a vehicle and so on, and includes an evaporator, a gas compressor, a condenser, and an expansion valve. Such an air-conditioning system configures a refrigerating cycle by circulating refrigerant gas G.

Figure 1:
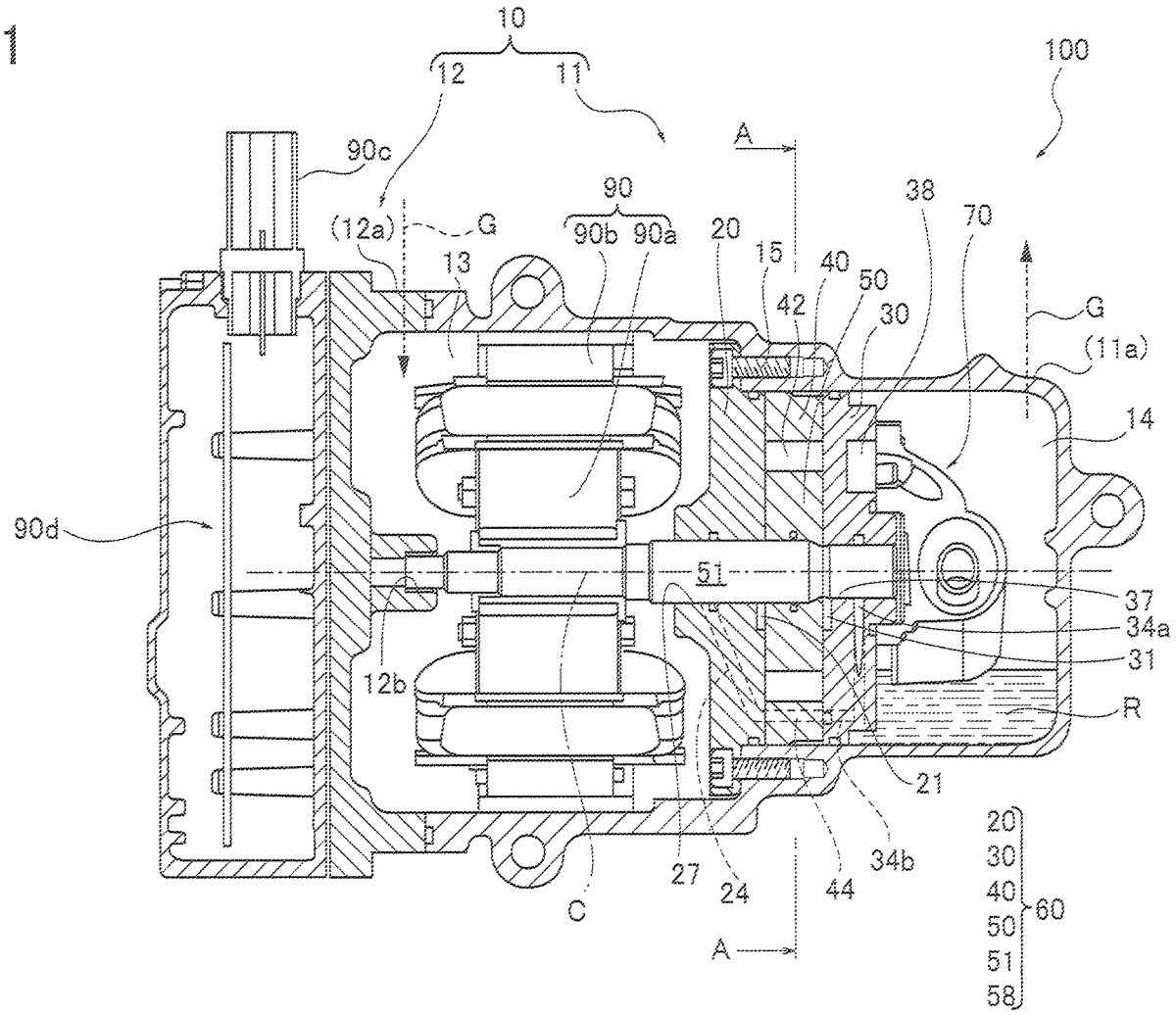
FIG. 1 is a longitudinal and sectional view illustrating a vane rotary compressor in an example of a gas compressor according to the present invention.

The compressor 100 includes a motor 90 and a compressor main body 60 which are housed inside a housing 10. The housing 10 is configured mainly by a main body case 11 and a front cover 12, as shown in FIG. 1.

The main body case 11 has an approximate cylindrical configuration. One end portion of the cylindrical configuration is shielded and the other end portion of the cylindrical configuration opens.

The front cover 12 is configured like a lid, and has contact with the end portion of the opening side of the main body case 11 so as to shield the opening. The front cover 12 is engaged with the main body case 11 integrally by a fastener member in the above-described condition, and configures the housing 10 so as to have a space inside thereof.

A suction port 12*a* is formed in the front cover 12. The suction port 12*a* connects the internal portion and the external portion of the housing 10, and conducts the low pressure refrigerant gas G from the evaporator in the air-conditioning system into the internal portion of the housing 10.

On the other hand, a discharge port 11*a* is formed in the main body case 11. The discharge port 11*a* connects the internal portion and the external portion of the housing 10, and discharges the high pressure refrigerant gas G from the internal portion of the housing 10 toward the condenser in the air-conditioning system.

A motor 90 which is disposed inside the main body case 11 configures a multi-phase brushless DC motor including a rotor 90*a* of a permanent magnet and a stator 90*b* of an electric magnet.

The stator 90*b* is fitted in and fixed to the inner-circumferential surface of the main body case 11. A rotation shaft 51 is fixed to the rotor 90*a*.

The rotor 90*a* and the rotation shaft 51 in the motor 90 are driven to rotate around the shaft center thereof by exciting the electric magnet of the stator 90*b* through an electric power supplied via a power connector 90*c* which is attached to the front cover 12.

Herein, the configuration in which an inverter circuit 90*d* and so on is included in between the power connector 90*c* and the stator 90*b* can be adopted.

As described above, the compressor 100 of the present Embodiment is operated electrically; however, the gas compressor according to the present invention is not always limited to be an electrically-driven compressor. It can be operated mechanically. When the compressor 100 according to the present Embodiment is operated mechanically, it is appropriate to configure the rotation shaft 51 to project from the front cover 12 toward the outside, and include a pulley, gear and so on, which receives power from an engine of a vehicle, on the leading end portion of the projecting rotation shaft 51, instead of including the motor 90.

The compressor main body 60 which is housed inside the housing 10 with the motor 90 is arranged side by side with the motor 90 along the extended direction of the rotation shaft 51. The compressor main body 60 is fixed to the main body case 11 by the fastener member 15 such as a bolt.

The compressor main body 60 housed in the housing 10 includes the rotation shaft 51 which is rotatable around the shaft center C by the motor 90, the approximate cylindrical rotor 50 which rotates integrally with the rotation shaft 51, the cylinder 40 which includes an inner-circumferential surface 41 having the contour shape to surround the outer-circumferential surface 52 of the rotor 50 from outside, five plate-like vanes 58 which are provided projectable from the outer-circumferential surface 52 of the rotor 50 toward the inner-circumferential surface 41 of the cylinder 40, and two side blocks (front side block 20 and rear side block 30) which shield both end portions of the rotor 50 and the cylinder 40.

Herein, the rotation shaft 51 is supported rotatable by a bearing 12*b*, which is formed in the front cover 12, and bearings 27, 37 which are formed in each side block 20 and 30 in the compressor main body 60.

The compressor main body 60 partitions the internal space of the housing 10 into the right side space and the left side space while being provided therebetween in the center as seen in FIG. 1.

In those two spaces partitioned inside the housing 10, the left side space in relation to the compressor main body 60 is a suction room 13 having low pressure atmosphere into which the low pressure refrigerant gas G from the evaporator through a suction port 12*a* is introduced. The right side space in relation to the compressor main body 60 is a discharge room 14 having high pressure atmosphere from which the high pressure refrigerant gas G through a discharge port 11*a* is discharged toward the condenser.

Herein, the motor 90 is arranged in the suction room 13.

Figure 2:
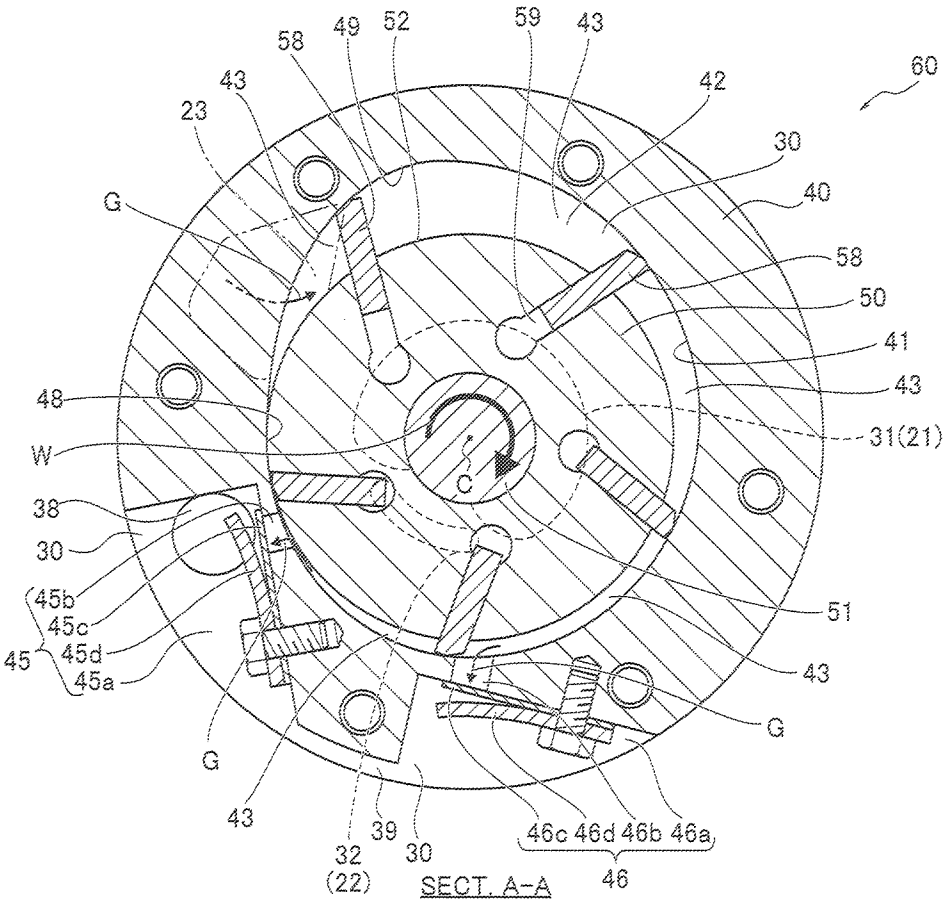
FIG. 2 is a sectional view along line A-A in a compressor section (compressor main body section only) in the vane-rotary compressor shown in FIG. 1.

As shown in FIG. 2, a single cylinder room 42 having an approximate C-shape is formed inside the compressor main body 60 while being surrounded by the inner-circumferential surface 41 of the cylinder 40, the outer-circumferential surface 52 of the rotor 50, and both side blocks 20 and 30.

In detail, the contour shape of the inner-circumferential surface 41 of the cylinder 40 is set such that the inner-circumferential surface 41 of the cylinder 40 and the outer-circumferential surface 52 of the rotor 50 come close to each other in only one position in the range of one revolution (360 degrees) of the rotation shaft 51 around the shaft center C. Thereby, the cylinder room 42 configures a single space.

A proximal section 48 is formed as a portion in which the inner-circumferential surface 41 of the cylinder 40 and the outer-circumferential surface 52 of the rotor 50 come close to each other at the most in the contour shape of the inner-circumferential surface 41 of the cylinder 40. The proximal section 48 is arranged in the position apart from a distant section 49, which is formed as a portion in which the inner-circumferential surface 41 of the cylinder 40 is apart from the outer-circumferential surface 52 of the rotor 50 at the most, at 270 degrees or more (under 360 degrees) on the downstream side along the rotational direction W (clockwise direction in FIG. 2) of the rotor 50.

The contour shape of the inner-circumferential surface 41 of the cylinder 40 is set so that the interval between the outer-circumferential surface 52 of the rotor 50 and the inner-circumferential surface 41 of the cylinder 40 decreases gradually from the distant section 49 to the proximal section 48 along the rotational direction W of the rotation shaft 51 and the rotor 50.

The vane 58 is housed in the vane groove 59 which is formed in the rotor 50. The vane 58 projects toward the outside from the outer-circumferential surface 52 of the rotor 50 by the back pressure caused by the refrigeration oil R and/or the refrigerant gas G supplied to the vane groove 59.

In addition, the vane 58 partitions the single cylinder room 42 into a plurality of compression rooms 43. One compression room 43 is formed by the two vanes 58 next to each other along the rotational direction W of the rotation shaft 51 and the rotor 50. Therefore, in the present Embodiment in which the five vanes 58 are disposed at intervals of an equal angle of 72 degrees around the rotation shaft 51, five to six compression rooms 43 are formed.

In the example in which the compression room 43 includes the proximal section 48 in between the two vanes 58 and 58, the proximal section 48 and the single vane 58 configure a single closed space, as a result, the compression room 43 which includes the proximal section 48 in between the two vanes 58 and 58 includes two compression rooms 43 and 43. Therefore, six compression rooms 43 are formed even if the five vanes are included.

The volume inside the compression room 43 which is formed by partitioning the cylinder room 42 by the vane 58 decreases gradually while the compression room 43 moves from the distant section 49 to the proximal section 48 along the rotational direction W.

A suction hole 23 faces a portion on the uppermost stream side in the rotational direction W (portion just proximal on the lower stream side in relation to the proximal section 48 along the rotational direction W). The suction hole 23 is formed in the front side block 20 and communicates with the suction room 13 (because the front side block 20 locates on the front side to the cross-sectional surface shown in FIG. 2, the suction hole 23 which is formed in the front side block 20 is indicated by the fictitious outline of a two-dot chained line).

On the other hand, a discharge hole 45*b* faces a portion on the lowermost stream side in the rotational direction W of the rotor 50 in the cylinder room 42 (portion just proximal on the upper stream side in relation to the proximal section 48 along the rotational direction W of the rotor 50). The discharge hole 45*b* communicates with a discharge chamber 45*a* in the first discharge section 45 which is formed in the cylinder 40. A discharge hole 46*b* which communicates with a discharge chamber 46*a* in a second discharge section 46 and is formed in the cylinder 40 faces the portion on the upper stream side than the discharge hole 45*b*.

The contour shape of the inner-circumferential surface 41 of the cylinder 40 is set so as to perform only one cycle of the suction of the refrigerant gas G from the suction room 13 through the suction hole which is formed in the front side block 20 toward the compression room 43, the compression of the refrigerant gas G in the compression room 43, and the discharge of the refrigerant gas G through the discharge hole 45*b* from the compression room 43 to the discharge chamber 45*a* during one revolution of the rotor 50.

The contour shape of the inner-circumferential surface 41 of the cylinder 40 on the uppermost stream side of the rotational direction W of the rotor 50 is set so that the interval between the inner-circumferential surface 41 and the outer-circumferential surface 52 of the rotor 50 increases drastically from the short state. The volume in the compression room 43 increases in accordance with the rotation in the rotational direction W within the angle range including the distant section 49, and the refrigerant gas G is sucked into the compression room 43 through the suction port 23 formed in the front side block 20 (suction stroke).

Next, because the contour shape of the inner-circumferential surface 41 of the cylinder 40 is set so that the interval between the inner-circumferential surface 41 and the outer-circumferential surface 52 of the rotor 50 gradually decreases toward the lower stream side in the rotational direction W, the volume of the compression room 43 decreases in accordance with the rotation of the rotor 50 in the above range, and the refrigerant gas G in the compression room 43 is thereby compressed (compression stroke).

Furthermore, the interval between the inner-circumferential surface 41 of the cylinder 40 and the outer-circumferential surface 52 of the rotor 50 further decrease on the lower stream side in the rotational direction W of the rotor 50 and the refrigerant gas G is further compressed. Then, the refrigerant gas G is discharged to the discharge chambers 45*a* and 46*a* of each discharge section 45 and 46 through the later-described discharge holes 45*b* and 46*b* when the pressure of the refrigerant gas G reaches the discharge pressure (discharge stroke).

By repeating the suction stroke, compression stroke, and discharge stroke through each compression room 43 in this order along the rotation of the rotor 50, the low pressure refrigerant gas G which is sucked from the suction room 13 becomes high pressure, and the high pressure refrigerant gas G is discharged to a cyclone block 70 (oil separator) which is an external device of the compressor main body 60.

Each discharge section 45 and 46 includes each discharge chamber 45*a* and 46*a* having a space surrounded by the outer-circumferential surface of the cylinder 40 and the main body case 11, each discharge hole 45*b* and 46*b* which connects the discharge chambers 45*a*, 46*a* and the compression room 43, each discharge valve 45*c* and 46*c* which opens the discharge hole 45*b* and 46*b* by the elastic deformation so as to bend toward the discharge chambers 45*a* and 46*a* through the differential pressure when the pressure of the refrigerant gas G in the compression room 43 is equal to the pressure (discharge pressure) inside the discharge chambers 45*a* and 46*a* or more, and closes the discharge hole 45*b* and 46*b* by the elastic power when the pressure of the refrigerant gas G is less than the pressure (discharge pressure) inside the discharge chambers 45*a* and 46*a*, and each valve support member 45*d* and 46*d* which prevents the discharge valve 45*c* and 46*c* from excessively bending toward the discharge chambers 45*a* and 46*a*.

In the two discharge sections 45 and 46, the discharge section which is disposed on the lower stream side of the rotational direction W, that is, the first discharge section 45 which is adjacent to the proximal section 48, is a primary discharge section.

Because the compression room 43 inside of which the pressure always reaches the discharge pressure faces the first discharge section 45 as the primary discharge section, at any time while the compression room 43 passes through the first discharge section 45, the refrigerant gas G compressed inside the compression room 43 is always discharged.

On the other hand, in the two discharge sections 45 and 46, the discharge section which is disposed on the upper stream side in the rotational direction W, that is, the second discharge section 46 which is away from the proximal section 48 is an auxiliary discharge section.

The second discharge section 46 as the auxiliary discharge section is arranged in order to prevent the excessive compression (compression to exceed the discharge pressure) in the compression room 43 in case the pressure in the compression room 43 reaches the discharge pressure before the compression room 43 faces the discharge section 45 on the lower stream side. The second discharge section 46 discharges the refrigerant gas G inside the compression room 43 only in the case in which the pressure in the compression room 43 reaches the discharge pressure while the compression room 43 faces the discharge section 46, and the second discharge section 46 does not discharge the refrigerant gas G inside the compression room 43 when the pressure inside the compression room 43 does not reach the discharge pressure.

As a result, a chattering caused by the discharge of the refrigerant gas G is not generated in the first discharge section 45 from which the refrigerant gas G having the discharge pressure is stationary discharged. However, the pulsation by the discharge of the refrigerant gas G is generated in the second discharge section 46 from which the refrigerant gas having the discharge pressure is discharged intermittently.

The discharge chamber 45*a* in the first discharge section 45 faces the discharge path 38 formed to penetrate to the outer surface (surface facing discharge room 14) of the rear side block 30. The discharge chamber 45*a* communicates with the cyclone block 70 which is attached to the outer surface of the rear side block 30 through the discharge path 38.

On the other hand, the discharge chamber 46*a* in the second discharge section 46 does not communicate directly with the cyclone block 70, but a cutout section formed on the outer-circumferential surface of the cylinder 40 is provided as a communicating path 39 which communicates with the discharge chamber 45*a* in the first discharge section 45. The communicating path 39 communicates with the cyclone block 70 through the discharge chamber 45*a* and the discharge path 38.

Therefore, the refrigerant gas G which is discharged to the discharge chamber 46*a* in the second discharge section 46 is discharged to the cyclone block 70 through the communicating path 39, the discharge chamber 45*a* and the discharge path 38 in this order.

The cyclone block 70 is disposed on the lower stream side in the flow of refrigerant gas G to the compressor main body 60, and separates the refrigerant oil R which is contained in the refrigerant gas G discharged from the compressor main body 60 from the refrigerant gas G.

In detail, by spirally circulating the refrigerant gas G which is discharged from the discharge hole 45*b* in the first discharge section 45 to the discharge chamber 45*a*, and is further discharged from the compressor main body 60 through the discharge path 38, and the refrigerant gas G which is discharged from the discharge hole 46*b* in the second discharge section 46 to the discharge chamber 46*a*, and is further discharged from the compressor main body 60 through the communicating path 39, the discharge chamber 45*a* in the first discharge section 45, and the discharge path 38, the refrigerant oil R is separated from the refrigerant gas G by the centrifugal separation.

Then, the refrigerant oil R which is separated from the refrigerant gas G is accumulated in the bottom section of the discharge room 14. The high-pressure refrigerant gas G after the refrigeration oil R is separated is discharged to the discharge room 14, and is further discharged to the condenser through the discharge port 11*a*.

The refrigerant oil R which is accumulated in the bottom section of the discharge room 14 is supplied to each vane groove 59 by the high-pressure atmosphere in the discharge room 14 through an oil path 34*a* which is formed in the rear side block 30 and cleaning flutes 31 and 32 of recess portions for supplying the back pressure, which are formed in the rear side block 30, and through the oil paths 34*a* and 34*b* formed in the rear side block 30, an oil path 44 formed in the cylinder 40, oil path 24 formed in the front side block 20, and cleaning flutes 21 and 22 of recess portions for supplying the back pressure, which are formed in the front side block 20.

That is, when the vane groove 59 which penetrates to the both end surfaces of the rotor 50 communicates with the cleaning flutes 21 and 31 or the cleaning flutes 22 and 32 in each side blocks 20 and 30 by the rotation of the rotor 50, the refrigerant oil R is supplied from the communicated cleaning flutes 21 and 31 or the cleaning flutes 22 and 32 to the vane groove 59, and thereby the pressure of the supplied refrigerant oil R becomes the back pressure which projects the vane 58 outside.

Herein, the path through which the refrigerant oil R passes between the oil path 34*a* and the cleaning flute 31 of the rear side block 30 is an extremely narrow clearance formed between the bearing 37 of the rear side block 30 and the outer circumferential surface of the rotation shaft 51 which is supported by the bearing 37.

Although the refrigerant oil R has high pressure which is equivalent to the high-pressure atmosphere of the discharge room 14 in the oil path 34*a*, the pressure of the refrigerant oil R becomes a middle pressure which is lower than the inside pressure of the discharge room 14 at the time of reaching the cleaning flute 31 as a result of the pressure drop while passing through the above-described narrow clearance.

The middle pressure herein is higher than the low pressure of the refrigerant gas G in the suction room 13, and is lower than the high pressure of refrigerant gas G in the discharge room 14.

Similarly, the path through which the refrigerant oil R passes between the oil path 24 in the front side block 20 and the cleaning flute 21 is an extremely narrow clearance formed between the bearing 27 in the front side block 20 and the outer circumferential surface of the rotation shaft 51 which is supported by the bearing 27.

Although the refrigerant oil R has the same high pressure as the high pressure atmosphere in the discharge room 14 in the oil path 24, the pressure of the refrigerant oil R becomes middle pressure which is lower than the inside pressure of the discharge room 14 when the refrigerant oil R reaches the cleaning flute 21 as a result of the pressure drop while passing through the above-described narrow clearance.

Accordingly, the back pressure which is supplied from the cleaning flutes 21 and 31 to the vane groove 59 and project the vane 58 toward the inner-circumferential surface 41 of the cylinder 40 is middle pressure of the refrigerant oil R.

On the other hand, because the cleaning flutes 22 and 32 communicate with the oil paths 24 and 34 without the pressure drop, the high-pressure refrigerant oil R similar to the pressure inside the discharge room 14 is supplied to the cleaning flutes 22 and 32. Therefore, in the last stage of the compression stroke in which the vane groove 59 communicates with the cleaning flutes 22 and 32, the chattering of the vane 58 is prevented by supplying the back pressure of high pressure to the vane 58.

The refrigerant oil R also has a function as a lubricant agent and a cooling medium at a contact portion such as a contact portion between the rotor 50 and the both side blocks 20 and 30, and a contact portion between the vane 58, cylinder 40, and both side blocks 20 and 30, by exuding from a clearance between the vane 58 and the vane groove 59, a clearance between the rotor 50 and the side blocks 20 and 30, and so on. The refrigerant oil R is separated by the cyclone block 70 because a part of the refrigerant oil R runs into the refrigerant gas G in the compression room 43.

According to the compressor 100 of the present Embodiment configured as described above, because the first discharge section 45 and the second discharge section 46 communicate on the upper stream side from the cyclone block 70 via the communicating path 39, the refrigerant gas G discharged from the second discharge section 46 enters into the cyclone block 70 after passing through the discharge path 38 where the refrigerant gas G discharged from the first discharge section 45 is discharged.

Thereby, it is not required to form each of the discharge path 38 for discharging the refrigerant gas G discharged from the first discharge section 45 to the outside of the compressor main body 60, and the discharge path for discharging the refrigerant gas G discharged from the second discharge section 46 to the outside of the compressor main body 60 independently on the outer-circumferential surface of the compressor main body 60 and/or on the cyclone block 70. Thus, the configuration of the compressor main body 60 and/or the cyclone block 70 can be simplified.

Moreover, if the chattering is generated in the discharge chamber 46*a* in the second discharge section 46 by the refrigerant gas G discharged intermittently to the discharge chamber 46*a*, the chattering is absorbed by the discharge chamber 45*a* in the first discharge section 45 which is connected by the communication path 39, so the chattering is disappeared or the pressure difference of the chattering is lowered.

Therefore, the generation of the chattering caused by the refrigerant gas G which is discharged from the compressor main body 60 can be prevented or moderated.

The compressor 100 according to the present Embodiment is configured to discharge the refrigerant gas G which is discharged to the second discharge section 46 to the first discharge section 45, and discharge the refrigerant gas G to the outside of the compressor main body 60 through the discharge path 38 which faces the first discharge section 45. On the other hand, it can be also configured to provide a discharge path penetrating to the outer-circumferential surface of the rear side block 30 so as to face the discharge chamber 46*a* in the second discharge section 46 and remove the discharge path 38 which is formed to face the discharge chamber 45*a* in the first discharge portion 45 in the above-described Embodiment, and discharge the refrigerant gas G which is discharged to the discharge chamber 45*a* in the first discharge portion 45 to the outside of the compression main body 60 through the communicating path 39, the discharge chamber 46*a* in the second discharge portion 46, and the discharge path.

Because the above-described compressor 100 in the Embodiment includes the second discharge section 46 on the upper stream side than the first discharge section 45, even when the pressure in the compression room 43 reaches the discharge pressure before the compression room 43 faces the first discharge section 45, the refrigerant gas G inside the compression room 43 is discharged from the compression room 43 through the second discharge section 46 when the compression room 43 faces the second discharge section 46 on the upper stream side than the first discharge section 45. Therefore, the excessive compression in the compression room 43 (compression to exceed the discharge pressure) can be prevented.

The compressor 100 according to the present Embodiment includes the communicating path 39 of a cutout portion which is formed on the outer circumferential surface of the cylinder 40 and communicates the discharge chamber 45*a* in the first discharge portion 45 and the discharge chamber 46*a* in the second discharge portion 46. However, it can be configured such that a through hole is formed in between the discharge chamber 45*a* in the first discharge section 45 and the discharge chamber 46*a* in the second discharge section 46 on the cylinder 40, instead of communicating path 39 shown in FIG. 2.

Figure 3:
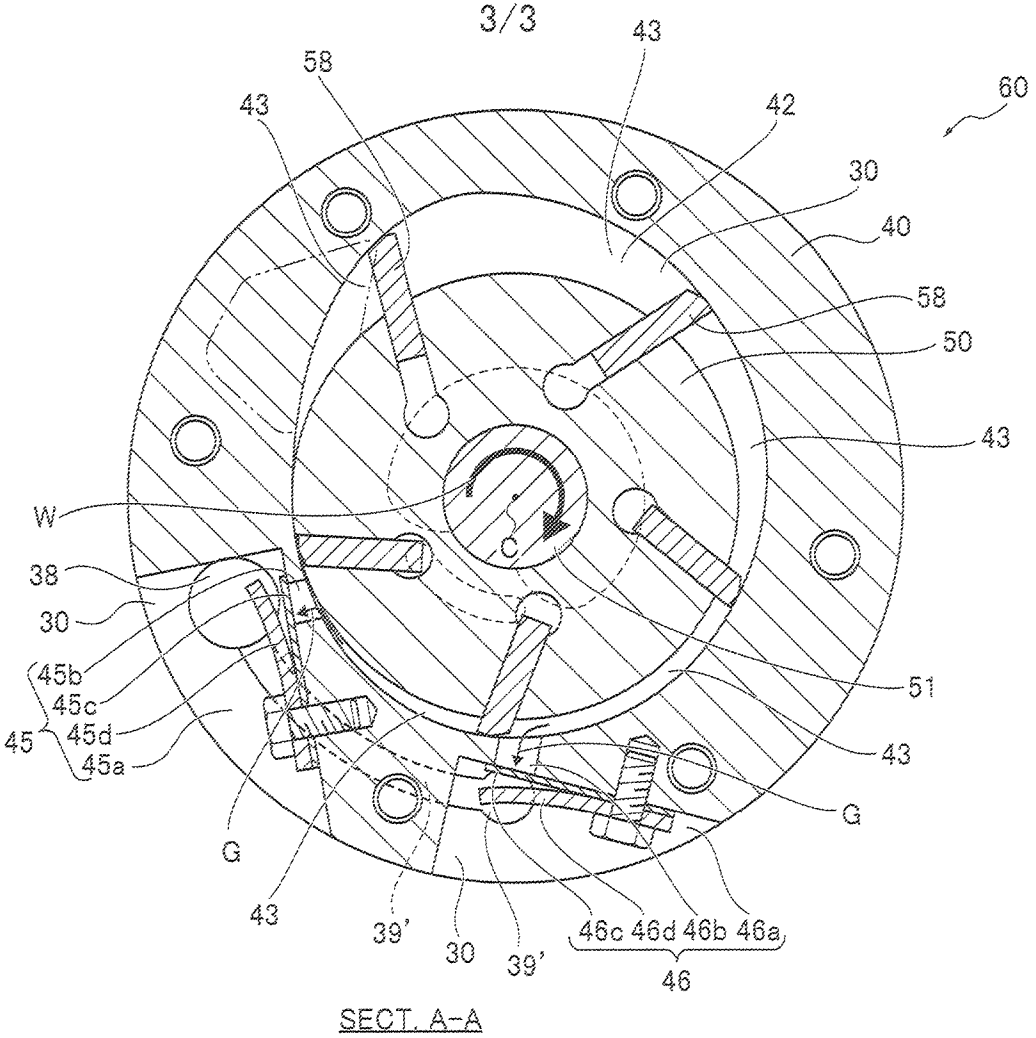
FIG. 3 is a sectional view illustrating a compressor of another example, similar to FIG. 2.

In addition, as shown in FIG. 3, it is also appropriate to form a groove 39' which connects the discharge chamber 45*a* in the first discharge section 45 and the discharge chamber 46*a* in the second discharge section 46 in the rear side block 30, so as not to penetrate to the outer circumferential surface (surface facing the discharge room 14) of the rear side block 30, instead of the communication path 39 shown in FIG. 2.

The compressor 100 in the above-described Embodiment includes the five vanes 58 but the gas compressor according to the present invention is not always limited to the above Embodiment, and the number of vanes can be appropriately selectable to be 2, 3, 4, 6, or so on. The gas compressor which includes the vanes selected as above ensures the similar functions and effects to the compressor 100 as described in the above Embodiment.

CROSS-REFERENCE TO RELATED APPLICATION

The present application is based on and claims priorities from Japanese Patent Applications No. 2012-126658, filed on Jun. 4, 2012, and No. 2012-126659, filed on Jun. 4, 2012, the disclosures of which are hereby incorporated by reference in their entirety.

EXPLANATION OF THE REFERENCE NUMERALS

20 front side block
30 rear side block
38 discharge path
39 communicating path
40 cylinder
43 compression room
45 first discharge portion
46 second discharge portion
45*a*, 46*a* discharge chamber
50 rotor
51 rotation shaft
58 vane
60 compressor main body
70 cyclone block (oil separator)
100 vane rotary compressor (gas compressor)
C shaft center (axis)

G refrigerant gas (gas)
R refrigerant oil (oil)
W rotational direction

The invention claimed is:

1. A gas compressor, comprising:

a compressor main body including:

an approximately cylindrical rotor that is rotatable around a shaft, a cylinder having an inner circumferential surface which has a contour shape surrounding the rotor from the outside of an outer circumferential surface of the rotor, the cylinder having a first discharge section therein that discharges gas at a discharge pressure, a plurality of plate-like vanes disposed to be projectable from the rotor toward the outside of the rotor by back pressure from a vane groove formed in the rotor, two side blocks that contact and shield end surfaces of the rotor and the cylinder, and a plurality of compression rooms which are partitioned inside the compressor main body by the rotor, the cylinder, the two side blocks and the vanes, wherein each compression room of the plurality of compression rooms is formed so as to perform only one cycle of suction, compression and discharge of gas through the first discharge section in the cylinder during one revolution of the rotor;

an oil separator that separates oil from the gas discharged from the compressor main body while the gas passes through the oil separator; and a discharge path connecting the first discharge section and the oil separator for flow of gas from the compressor main body to the oil separator;

wherein the cylinder includes a second discharge section that discharges the gas inside the compression room when the pressure of the gas inside the compression room reaches the discharge pressure before the compression room faces the first discharge section during rotation of the rotor; and wherein a communicating path connects the second discharge section to the first discharge section such that gas discharged through the second discharge section must flow through the communicating path before reaching the discharge path to the oil separator.

2. The gas compressor of claim 1, wherein the communicating path is a cutout section or a through-hole formed on an outer-circumferential surface of the cylinder to connect the first discharge section and the second discharge section.

3. The gas compressor of claim 1, wherein the communicating path is a groove formed on at least one of the two side blocks to connect the first discharge section and the second discharge section.

* * * * *